United States Patent [19]

Theurer et al.

[11] 4,316,416

[45] Feb. 23, 1982

[54] MOBILE APPARATUS FOR REPLACING OLD TRACK TIES BY NEW TRACK TIES

[75] Inventors: Josef Theurer, Vienna; Friedrich Oellerer, Linz, both of Austria

[73] Assignee: Franz Plasser Bahnbaumaschinen-Industriegesellschaft m.b.H., Vienna, Austria

[21] Appl. No.: 70,314

[22] Filed: Aug. 27, 1979

[30] Foreign Application Priority Data

Sep. 13, 1978 [AT] Austria ..... 6629/78

[51] Int. Cl.[3] ..... E01B 27/02; E01B 27/11

[52] U.S. Cl. ..... 104/2; 37/104; 104/6; 104/7 R; 171/16

[58] Field of Search ..... 104/1 R–7 R, 104/7 A, 7 B; 171/16; 37/104–107; 414/339, 528

[56] References Cited

U.S. PATENT DOCUMENTS

| | | | |
|---|---|---|---|
| 2,142,208 | 1/1939 | Protzeller | 171/16 X |
| 3,612,184 | 10/1971 | Plasser et al. | 171/16 |
| 3,680,233 | 8/1972 | MacDonald | 37/108 |
| 3,699,894 | 10/1972 | Plasser et al. | 104/2 |
| 4,004,524 | 1/1977 | Scheuchzer et al. | 104/2 |
| 4,160,418 | 7/1979 | Theurer | 104/2 |

FOREIGN PATENT DOCUMENTS

| | | | |
|---|---|---|---|
| 187132 | 10/1956 | Austria | 104/2 |
| 1067463 | 10/1959 | Fed. Rep. of Germany | 104/2 |
| 1658362 | 3/1971 | Fed. Rep. of Germany | 104/2 |
| 60591 | 4/1954 | France | 104/7 A |
| 1346071 | 11/1963 | France | 104/2 |
| 1339842 | 12/1973 | United Kingdom | 104/2 |

*Primary Examiner*—Randolph A. Reese
*Attorney, Agent, or Firm*—Kurt Kelman

[57] ABSTRACT

A track renewal train includes a vehicle bridging an intermediate right of way section between an old and a new track section, and this vehicle carries rail spreaders as well as equipment arranged in succession for removing the ties of the old track section, for lowering the level of, and planing, the ballast in the intermediate right of way section and for laying the ties of the new track section. The ballast lowering and placing equipment includes a ballast planing shield mounted on the vehicle and having a width at least equal to the length of the ties of the new track section, a ballast conveyor elevator associated with the ballast planing shield, the elevator extending over the width of the shield and having an input end adjacent the front end of the shield and an output end at the trailing end of the shield, and a ballast dumping conveyor arranged to receive ballast from the output end of the elevator. The ballast dumping conveyor bridges over the spread rails guided in the longitudinal direction of the train and has ballast outlets laterally outwards of the spread rails or in the cribs of the new track section.

6 Claims, 3 Drawing Figures

MOBILE APPARATUS FOR REPLACING OLD TRACK TIES BY NEW TRACK TIES

Figures 1, 2, 3:
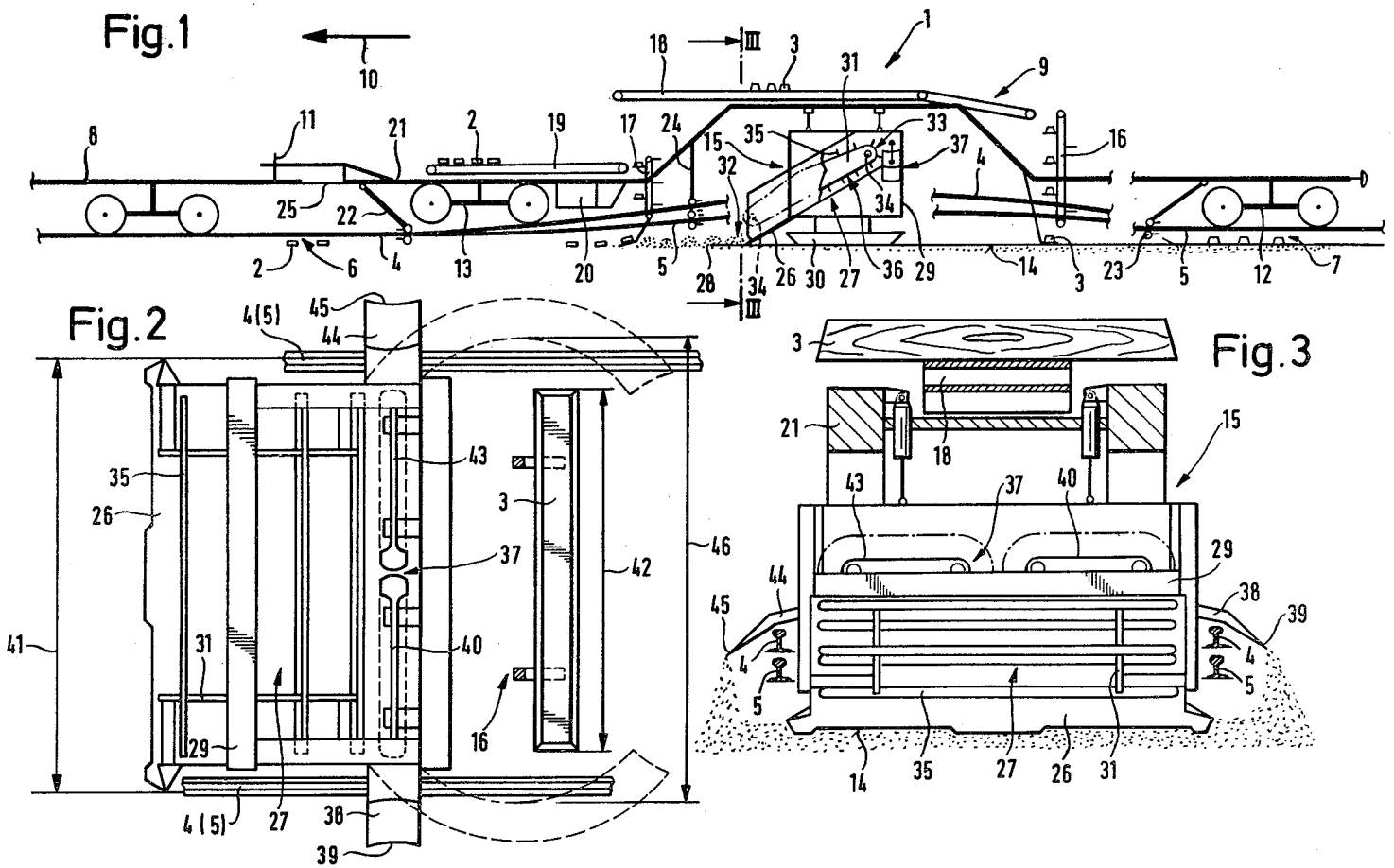

The present invention relates to improvements in a mobile apparatus for replacing old track ties by new track ties, which comprises a track renewal train mounted for movement along a right of way consisting of an old track section, a new track section and an intermediate right of way section wherein the track is renewed, the train including a vehicle bridging the intermediate right of way section and carrying means for spreading the rails of the old and new track sections to a distance at least equal to the length of the ties and for guiding the spread rails in the longitudinal direction of the train, as well as equipment arranged in succession in this direction for removing the ties of the old track section, for lowering the level of, and planing, the ballast in the intermediate right of way section and for laying the ties of the new track section.

In U.S. Pat. No. 4,160,418, dated July 10, 1979, whose inventor is one of the joint inventors herein, a mobile apparatus of this general type has been disclosed wherein an endless ballast excavating chain moving in a triangular path has been mounted between the equipment for removing the old tie and for laying the new ties to lower the level of, and plane, the ballast. The excavated ballast is conveyed and distributed in the range of the laid ties and is used to fill the cribs between these ties. The excavating chain as well as the ballast conveyor means and ballast distributing chutes are mounted between the spread rails. This apparatus has been commercially quite successful but requires a relatively high conveyance speed for the ballast excavating chain to enable it to remove the desired amount of ballast for lowering the level of, and planing, the ballast. This, in turn, requires relatively expensive guide and drive means for the excavating chain. Furthermore, the chain is subject to rapid wear because of the relatively large amounts of ballast carried thereby. British Pat. No. 1,339,842, published Dec. 5, 1973 also uses a ballast excavating chain in a mobile track renewal machine.

Austrian Pat. No. 187,132 published Dec. 15, 1955, discloses a mobile apparatus for cleaning ballast wherein a ballast planing shield for lowering the level of, and planing, ballast is mounted at the front end of a full-track vehicle, the ballast planing shield having a width at least equal to the length of the ties. This shield has a front end for engagement with the ballast and extends obliquely upwardly towards the vehicle, providing a trailing output end for the ballast removed by the front end. To enable the ballast to move up along the obliquely inclined shield, a considerable pushing force must be exerted on the shield by the full-track vehicle. When the vehicle is stopped for some reason during the operation, resumption of its forward thrust will cause the tracks of the vehicle to revolve in place before the vehicle moves forward and this will cause the previously planed ballast to be deformed by the revolving tracks.

U.S. Pat. No. 3,680,233, dated Aug. 1, 1972, discloses an excavating loader with a pivotal discharge conveyor. This earth removal machine uses a digger scoop mounted at the front of a half-track tractor and a scraper blade is mounted at the mouth of the scoop for lowering the level of, and planing, the excavated material. A bucket elevator is associated with the scoop to receive the excavated material and move it away. The conveyance of the material by the elevator enables the apparatus to move forward without undue power from the tractor, which somewhat reduces the danger of the planed surface to be disfigured by the succeeding half-tracks of the tractor but does not entirely eliminate this danger. A swivel conveyor is provided for removing and loading the excavated material. When loading is changed from one side to the other, the conveyor must be swung over the planed surface and any material dropped from the conveyor again may cause unevenness of the surface. In addition, the loader of this patent is relatively long and could not be accommodated in the relatively crowded space available in the intermediate right of way section between an old and a new track where track renewal trains renew the track.

U.S. Pat. No. 3,612,184, dated Oct. 12, 1971, discloses a mobile ballast sweeping and redistribution machine wherein an elevator receives ballast swept up by a rotary broom.

In the track renewal operation disclosed by German Published Application No. 1,658,362, published Mar. 18, 1971, a flat plate with a front cutting edge is used for engaging the ballast to lower the level of, and plane, the ballast.

It is the primary object of this invention to improve a mobile apparatus of the first-indicated type so as to obtain an accurately planed ballast bed with ballast lowering and planing equipment of relatively short extension and compact construction to be readily incorporated in the work vehicle of a track renewal train.

The above and other objects are accomplished according to the invention with ballast lowering the planing equipment which includes a ballast planing shield mounted on the vehicle and having a width at least equal to the length of the ties of the new track section. The ballast planing shield has a front end for engagement with the ballast and a trailing end. A ballast conveying elevator is associated with the ballast planing shield and extends over the entire width of the shield. The elevator has an input end adjacent the front end of the shield and an output end at the trailing end of the shield. A ballast dumping device is arranged to receive ballast from the output end of the elevator, the ballast dumping device bridging over the spread rails guided by the rail spreading and guiding means and has ballast outlet means laterally outwards of the spread rails or in the cribs of the new track section.

With this arrangement, it has become possible to use the advantageous compact construction of a planing shield in association with an elevator in a track renewal train so as to obtain an exact ballast bed profile enabling the new ties to be laid thereon. With the ballast outlet means of the ballast dumping device outwards of the spread rails and the dumping device bridging over the spread rails, any dropping of ballast onto the planed ballast bed or the rails is avoided so that the planed ballast will remain intact. At the same time, the distribution of the ballast in the region of the newly laid ties also is such that it will not interfere with the guidance of the rails or any other track renewal equipment. A further advantage of the arrangement is that a portion of the loads to which the track renewal train vehicle is subjected is transmitted by the ballast lowering the planing equipment to the ballast so that the load of this equipment on the vehicle is reduced or even eliminated. Even a portion of the load of other equipment carried by the vehicle may be transmitted to the ballast bed by the ballast lowering and planing equipment. Since the elevator has ballast entrainment elements extending substantially over the entire width of the ballast bed, relatively few entrainment elements moving at low speed suffice to remove the ballast, which reduces the wear. This, in turn, enables the guide and drive means for the elevator to be of simple construction and reduces the construction costs.

The above and other objects, advantages and features of the present invention will become more apparent from the following detailed description of a now preferred embodiment thereof, taken in conjunction with the accompanying schematic drawing wherein FIG. 1 is a side elevational view of a portion of a mobile apparatus for replacing old track ties by new track ties, which includes the vehicle bridging the intermediate right of way section, FIG. 2 shows an enlarged top view of the ballast lowering and planing equipment according to this invention, a modification of the ballast distributing chutes being illustrated in broken lines, and FIG. 3 is an enlarged end view of the ballast lowering and planing equipment, seen in the direction of arrows III—III of FIG. 1.

Referring now to the drawing and first to FIG. 1, mobile apparatus 1 for replacing old track ties 2 by new track ties 3 comprises a track renewal train mounted for movement in the direction of arrow 10 along a right of way consisting an old track section 6 including rails 4, new track section 7 including rails 5 and an intermediate trackless right of way section wherein the track is renewed. The track renewal train comprises a series of freight cars 8 (only one being shown) and vehicle 9 bridging the intermediate right of way section. A forward end of vehicle 9 is pivotally supported by kingpin 11 on car 8 moving on the old track and wheeled undercarriage 12 supports the rear end of the vehicle on the new track. Another wheeled undercarriage 13 is retractably mounted at the forward end of vehicle 9 and is lowered into engagement with the track rails when the train is moved from one renewal site to another.

Frame 21 of vehicle 9 carries means 22, 24, 23 for spreading rails 4 and 5 to a distance at least equal to the length of the ties and for guiding the spread rails in the longitudinal direction of the train laterally along the two sides of vehicle 9, as well as equipment arranged in succession in this direction for removing ties 2 of old track section 6 (at 17), for lowering the level of, and planing ballast 14 in the intermediate right of way section (at 15) and for laying ties 3 of new track section 7 (at 16). The rail spreading and guiding means as well as tie removing and laying equipment 17, 16 are conventional, the latter comprising vertical tie conveyors. The tie conveyor of tie removing equipment 17 is associated with a tie engaging element which receives successive ties as the train moves in the direction of arrow 10 and the ties are transferred from the tie engaging element to the vertical tie conveyor which moves them to elongated conveyor 19 mounted on vehicle frame 21 and conveying the ties to freight car 8. The tie conveyor of tie laying equipment 16 receives new ties 3 from conveyor 18 supplied from a store of new ties on freight cars coupled to vehicle 9 and moves successive new ties to a tie laying element which deposits the new ties on the planed ballast bed, all of these structures and operations being conventional. Central operator's cab 20 is mounted on vehicle frame 21 within sight of tie removing equipment 17 to monitor the operation of the track renewal. As is also known and forms no part of the present invention, a gantry crane (not shown) is used to move the old ties from, and the new ties to, vehicle 9 and this gantry crane runs along the train on rails 25 mounted laterally on the train cars.

In accordance with this invention, ballast lowering and planing equipment 15 includes ballast planing shield 26 mounted on vehicle 9 and having a width 41 at least equal to length 42 of ties 3 of the new track section, width 41 exceeding length 42 in the embodiment shown in FIG. 2. The ballast planing shield has a front end 32 for engagement with ballast 28 and a trailing end 33. Ballast conveying elevator 27 is associated with ballast planing shield 26 and extends over the width of the shield. The elevator has an input end adjacent the front end of the shield and an output end at trailing end 33 of the shield.

In the illustrated embodiment, ballast planing shield 26 and ballast conveying elevator 27 are mounted on carrier frame 29 which, in turn, is vertically movably mounted on vehicle frame 21 and is supported on planed ballast bed 14 by ballast planing plate 30 mounted on the carrier frame for engagement with the ballast when the frame is lowered into operating position and vehicle 9 is moved with the track renewal train in the direction of arrow 10 during the track renewal operation. Ballast conveying elevator 27 includes endless conveyor 31 and respective conveyor support rollers or pulleys 34 at the front and trailing ends 32, 33 of planing shield 26, endless conveyor 31 being trained over rollers 34. The endless conveyor may be constituted by cables, chains or a conveyor band and a series of ballast entrainment elements 35 are mounted thereon and extend over the width of shield 26. Endless conveyor 31 has a lower stringer 36 extending substantially parallel to, and spaced from, ballast planing shield 26 by a distance corresponding to the thickness of layer of ballast 28 to be removed by the elevator. The lower conveyor stringer is movable in the direction of trailing end 33 of shield 26 so that successive ballast entrainment elements 35 pick up ballast 28 at front end 32 of shield 26, as the front edge of the shield digs into the ballast on forward movement of vehicle 9, and move the picked-up ballast upwards along shield 26 in the space between the shield and lower conveyor stringer 36 to trailing end 33 of the shield, which is the output end of the ballast conveying elevator. Ballast dumping device 37 is arranged to receive ballast from the output end of elevator 27 and this device bridges over spread rails 4, 5 guided by means 24 and has ballast outlet means 39, 45 laterally outwards of the spread rails.

This preferred embodiment illustrated herein and described hereinabove enables the weight of the equipment for lowering the level of, and planing, the ballast and of the ballast carried thereby to be used for precompacting the planed ballast while vehicle frame 21 is not subjected to any appreciable degree to the load of this equipment. Furthermore, the ballast is conveyed upwards along the obliquely mounted ballast planing shield by the elevator so that the power required for the forward movement is reduced to a minimum. The space between the lower stringer of the endless conveyor and the shield makes it possible to convey layers of ballast of different thickness in a uniform manner over the entire width of the shield, which improves the distribution of the ballast by the succeeding ballast dumping device, particularly the uniform distribution of ballast to both track shoulders.

As shown in FIGS. 2 and 3, ballast dumping device 37 comprises two transverse conveyors 40, 43 mounted beyond trailing end 33 of ballast planing shield 26, each transverse conveyor extending over half a width of the shield. The shield has a width 41 exceeding length 42 of new ties 3 and ballast entrainment elements 35 extend over almost the entire width of shield 26 to convey ballast 28 to conveyors 40, 43. Ballast outlet chutes 38 and 44 are associated with the transverse conveyors and bridge over rails 4, 5 so that their respective outlets 39 and 45 discharge the ballast outwards of the spread rails along the shoulders of the track.

The arrangement of two separate transverse ballast dumping conveyors enables the ballast conveyed thereto uniformly by elevator 27 to be distributed to the respective track shoulders at varying distances from the track by changing the discharge range of the conveyors. For instance, by speeding up the movement of a selected conveyor, the arc over which the ballast will be thrown off from the output will be increased so that the ballast will be deposited farther outwards.

As shown in broken lines in FIG. 2, ballast outlet chutes 38 and 44 may be modified to extend above rails 4, 5 in the direction of the right of way laterally of tie laying equipment 16 into the region of this equipment, the transverse distance 46 between chutes 38, 44 in this region exceeding length 42 of ties 3 to be laid. In this manner, ballast 28 which is dug up by ballast planing shield 26 and conveyed by elevator 27 and transverse dumping conveyors 40, 43 is distributed directly into the cribs of new track section 7 between newly laid ties 3. With this arrangement, no intermediate ballast storage is required for filling the cribs of the new track section with ballast while the spread rails interfere neither with the accurate planing of the ballast bed nor with the distribution of the ballast to the new track section. In addition, the new ties are laid without interference from the ballast distributing equipment.

As will be noted from the end view of FIG. 3, the ballast scraping edge at the front end of ballast planing shield 26 has projecting center and end portions to shape the ballast bed so that new ties 3 are supported on two ballast supports at the ends of the ties but not in the middle. Outlets 39 and 45 are arranged to distribute the ballast on the shoulders outwards of spread rails 4, 5 in this embodiment.

Ballast lowering and planing equipment 15 according to the present invention may be used in mobile track renewal trains differing in structure from the illustrated embodiment. For instance, track renewal vehicle 9 may be at least temporarily supported on at least one full-track undercarriage instead of track-bound undercarriages 12, 13, such a full-track undercarriage being arranged, for example, between planing shield 26 and tie laying equipment 16.

What is claimed is:

1. A mobile apparatus for replacing old track ties by new track ties resting on ballast, which comprises a track renewal train mounted for movement along a right of way consisting of an old track section, a new track section and an intermediate right of way section wherein the track is renewed, the train including a vehicle bridging the intermediate right of way section and having an upwardly recessed frame defining a free space between the frame and ballast, the vehicle carrying means for spreading the rails of the old and new track sections to a distance at least equal to the length of the ties and for guiding the spread rails in the longitudinal direction of the train, as well as means for removing the ties of the old track section arranged frontwards of the free space, means for laying the ties of the new track section arranged rearwardly of the free space, and a carrier frame arranged in the free space for equipment for lowering the level of, and planing, the ballast in a first zone of the intermediate right of way section to obtain a section of lowered and planed ballast therein, the ballast lowering and planing equipment including a ballast planing shield, a ballast conveying elevator, a ballast planing plate and a ballast dumping device, the ballast planing shield extending across the intermediate right of way section in the free space and having a width at least equal to the length of the ties of the new track section, the ballast planing shield having a front end for scraping engagement with the ballast in the first zone and extending obliquely upwardly to a trailing end, the ballast conveying elevator being associated with the ballast planing shield and extending therealong and obliquely upwardly substantially parallel thereto, the free space being of sufficient height to accommodate the elevator and the elevator extending over the width of the shield and having an input end adjacent the front end of the shield and an output end at the trailing end thereof, the ballast planing plate extending horizontally for engagement with the lowered and planed ballast between the first zone and the tie laying means, and the ballast dumping device being arranged to receive ballast from the output end of the elevator, the ballast dumping device bridging over the spread rails guided by said means and having ballast outlet means arranged to discharge the dumped ballast in another zone outside the lowered and planed ballast between the first zone and the tie laying means.

2. The mobile apparatus of claim 1, wherein the other zone is laterally outwards of the spread rails.

3. The mobile apparatus of claim 1, wherein the other zone is in the cribs of the new track section.

4. The mobile apparatus of claim 2, or 3, the ballast conveying elevator including an endless conveyor, respective conveyor support rollers adjacent the front and trailing ends of the planing shield, the endless conveyor being trained over the rollers, and a series of ballast entrainment elements extending over the width of the shield and mounted on the endless conveyor, the endless conveyor having a lower stringer extending substantially parallel to, and spaced from, the planing shield by a distance corresponding to the thickness of layer of ballast to be removed by the elevator, and the lower conveyor stringer being movable in the direction of the trailing end of the shield.

5. The mobile apparatus of claim 2 or 3, wherein the ballast dumping device comprises two transverse conveyors mounted beyond the trailing end of the planing shield, each transverse conveyor extending over half a width of the shield, and a ballast outlet chute associated with each transverse conveyor and bridging over the rails.

6. The mobile apparatus of claim 5, wherein the ballast outlet chutes extend above the rails in the direction of the right of way into the region of the equipment for laying the ties of the new track section, the transverse distance between the chutes in said region exceeding the length of the ties to be laid.

* * * * *